US005387290A

United States Patent [19]

Kolinsky

[11] Patent Number: 5,387,290

[45] Date of Patent: Feb. 7, 1995

[54] HAND POLISHING TECHNIQUE FOR AUTOMOBILES AND OTHER VEHICLES

[76] Inventor: Jay N. Kolinsky, Old Stone Hill Rd., Pound Ridge, N.Y. 10576

[21] Appl. No.: 12,880

[22] Filed: Feb. 3, 1993

Related U.S. Application Data

[63] Continuation-in-part of Ser. No. 958,608, Oct. 8, 1992, abandoned, which is a continuation of Ser. No. 766,027, Sep. 26, 1991, abandoned.

[51] Int. Cl.[6] ..... A47L 13/16

[52] U.S. Cl. ..... 134/32; 134/42; 15/244.1; 15/244.4

[58] Field of Search ..... 134/42, 6, 32; 15/97.3, 15/244.1, 244.2, 244.4; 401/38, 39

[56] References Cited

U.S. PATENT DOCUMENTS

| | | | |
|---|---|---|---|
| 752,475 | 2/1904 | Smith | 51/392 |
| 1,807,137 | 5/1931 | Robbins | 15/209 |
| 2,242,947 | 5/1941 | Griffis | 15/209 R |
| 2,458,391 | 1/1949 | Lavietes | 145/50 |
| 2,739,334 | 3/1956 | Hardey | 15/231 |
| 2,755,494 | 7/1956 | Bredin | 15/104 |
| 2,817,106 | 12/1957 | Putz | 15/244.1 |
| 2,829,393 | 4/1958 | Turcotte | 15/131 |
| 3,090,064 | 5/1963 | Garrett | 15/209 |
| 3,100,311 | 8/1963 | Tutino | 15/209 |
| 3,161,903 | 5/1963 | Worthington | 15/244.1 |
| 3,517,406 | 1/1967 | Stephens | 15/209 |
| 4,077,083 | 3/1978 | Siemund | 15/244.1 |
| 4,085,475 | 4/1978 | Silver | 15/209 D |
| 4,094,036 | 6/1978 | Karpp | 15/244 R |
| 4,315,342 | 2/1982 | Ash | 15/121 |
| 4,351,081 | 9/1982 | Tarkinson | 15/210 R |
| 4,486,109 | 12/1984 | Rosofsky | 401/24 |
| 4,543,680 | 10/1985 | Vlahos | 15/145 |
| 4,750,233 | 6/1988 | Swain | 15/118 |
| 4,811,445 | 3/1989 | Lagieski et al. | 15/104.94 |
| 4,970,750 | 11/1990 | Davis, III | 15/244.1 |
| 5,003,659 | 4/1991 | Paepke | 15/209 |
| 5,099,541 | 3/1992 | Tressler | 15/257.05 |

FOREIGN PATENT DOCUMENTS 300877 11/1954 Switzerland .

*Primary Examiner*—Michael Lewis
*Assistant Examiner*—Thomas G. Dunn, Jr.
*Attorney, Agent, or Firm*—Ostrolenk, Faber, Gerb & Soffen

[57] ABSTRACT

A method of hand cleaning or polishing an exterior body surface of a vehicle, e,g., an automobile, without undue fatigue. A working pad is formed with a handle attachment part having a first flat surface substantially parallel with a bottom work surface of the pad. A handle is provided with a pad engaging part having a second flat surface. The handle and the working pad are configured to fit with one another by friction, and the first and the second flat surfaces then become aligned flush. The work surface of the pad is placed on the vehicle body surface after applying a suitable cleaning or polishing agent, and the pad is wiped via the fitted handle over the vehicle body while exerting a downward force.

11 Claims, 2 Drawing Sheets

HAND POLISHING TECHNIQUE FOR AUTOMOBILES AND OTHER VEHICLES

CROSS-REFERENCE TO RELATED APPLICATIONS

The present application is a continuation-in-part of my co-pending application Ser. No. 07/958,608 filed Oct. 8, 1992, and entitled "Hand polishing System" now abandoned. The '608 application is a continuation of my application Ser. No. 07/766,027 filed Sep. 26, 1991, and now abandoned.

BACKGROUND OF THE INVENTION

1. Field of the Invention

The present invention is directed generally to vehicle body surface cleaning and polishing techniques, and more particularly to a hand polishing technique for automobiles in which cleaning and polishing of a vehicle body surface is carried out by fitting a handle in a recess formed in a polishing pad, grasping the handle, and wiping the body surface with the pad while the pad remains fitted to the handle.

2. Description of the Known Art

Polishing pad arrangements for use on automobile body surfaces are known in which one or more polishing pads of foam material each have a hollow rubber attachment cup provided on an upper surface. The pads are detachably mountable on a power drive disk that is driven by an electric motor. Such units exist in the form of commercial power orbital polishers and are described below in connection with FIGS. 1 and 2.

Motor driven polishing pad arrangements have a disadvantage in that movement of the pad relative to the automobile body surface is largely defined by the rotary movement of the motor shaft or shafts. This makes it impossible for the user to impart a purely back-and-forth, non-rotational motion to the pad while wiping it over the surface to be polished. In fact, for some applications, it may be harmful to engage a painted body surface with a high speed rotating polishing pad. Surface paint or other finish not intended to be removed may inadvertently be quickly lost due to excessive frictional forces and heating.

Further, the motor and drive gear units of the commercial power polishers are themselves much heavier than the polishing pads attached to them. It therefore becomes difficult for the user to know just how much downward force he or she is exerting as the pads are driven over a body surface under power. Again, this may present a problem for delicate surface finishes.

Safety hazards are also present when using an electrically powered polishing pad unit outdoors if the unit is not properly grounded and/or the user is standing on a wet driveway as is often the case after washing a car prior to polishing it. Also, the powered units can only be used near a source of power such as the AC mains or compressed air.

As far as is known, no vehicle body cleaning, polishing or waxing technique exists in which a handle contoured to fit comfortably in a user's hand is frictionally engaged with a polishing pad, and the pad is then wiped via the handle over the body surface after applying a suitable polishing or cleaning agent.

U.S. Pat. No. 1,807,137 (May 26, 1931) shows a steel wool pad and holder arrangement for abrasive purposes. In one embodiment, a wooden holder is formed as a handle. A felt pad is attached to the bottom of the holder, and cups of wound steel wool ribbon are mounted on the pad. The patent is concerned with the tendency of steel wool to disintegrate into fine pieces when used for abrasive purposes, and purports to solve the problem by winding the wool in continuous ribbons or strands.

U.S. Pat. No. 5,003,659 (Apr. 2, 1991) discloses a kitchen cleaning and scrubbing tool. The tool includes a sponge having a layer of loop material on a top surface. A handle has a layer of hook material on a bottom surface for gripping the loop material on the sponge. The handle is in the form of a hollow knob for gripping by the thumb and the finger. The patent also discloses an extension handle with a nosed end adapted to fit into a central opening in the knob. U.S. Pat. No. 4,970,750 (Nov. 20, 1990) also shows a household (e.g., bathtub and shower) cleaning device in the form of a sponge block having a rectangular polyhedron shape. The sponge block has a cavity in its top surface, and a rigid support block is inlaid in the cavity and permanently adhered to the sponge block by an elastic adhesive. The support block also has a threaded opening for engaging threads at the end of a long handle.

U.S. Pat. No. 2,829,393 issued Apr. 8, 1958, discloses a cosmetics and lotion applicator for use in applying lotions or creams to the body including one's back. The applicator comprises a pad of porous material which is slipped over a round concave frame from which a long handle extends parallel to the plane of the frame. A cavity defined between the frame and the pad is filled with liquid cosmetic, which is dispensed through the porous pad while the applicator is being used.

U.S. Pat. No. 2,817,106 (Dec. 24, 1957) shows a dish washing and cleaning tool comprised of a disc-shaped sponge pad, and a shell-like rigid handle permanently adhered to the sponge pad by a water-insoluble adhesive. When the handle is gripped and squeezed, a tube containing a liquid detergent inside the handle discharges the detergent onto the sponge pad.

The foregoing patents relate to abrading or cleaning devices having handles and working pads of various forms and materials, for carrying out specific tasks. None of the patents, however, discloses or suggests a handle and pad combination particularly suited for the hand polishing of painted vehicle body surfaces. In particular, none of the known art suggests a technique that enables hand polishing or waxing of a vehicle in such a manner that little if any of the muscle cramps or fatigue, commonly associated with present hand polishing or waxing methods, will be experienced.

An object of the invention is to provide a hand polishing technique for automobiles and other vehicles, whereby the exterior body surface of the automobile can be cleaned and polished effectively and without undue fatigue.

Another object of the invention is to provide a vehicle hand polishing technique whereby a friction fit is established between either a base part of a handle and a hollow recess in a polishing pad, or a handle attachment part of a polishing pad and a hollow recess in the base part of the handle.

Another object of the invention is to provide an even distribution of working pressure through a larger flat surface as compared with the uneven distribution of pressure exerted by fingertips or palms in the common polishing methods.

Yet another object of the invention is to provide a hand polishing technique whereby the base of a pistol-grip handle is adapted to engage a polishing pad by friction, thereby allowing a user's hand to apply a working force comfortably from the side end of the fist directly and evenly over the surface of the polishing pad.

Another object of the invention is to provide a vehicle hand polishing technique that provides results comparable with those obtained with machine powered polishers, but at much less cost.

Yet another object of the invention is to provide a vehicle hand polishing technique that consumes appreciably less time to complete than other common hand polishing methods.

A further object of the invention is to provide a vehicle hand polishing technique whereby a friction fit is established between a handle and a polishing pad, and the pad will separate from the handle during use thereby alerting the user that additional liquid or paste polish must be applied to the vehicle.

Another object of the invention is to provide a hand polishing technique whereby a comfortable handle and a polishing pad are fitted to one another by friction thereby protecting the pad from being torn during use, since the pad is not permanently attached to the handle by any adhesive or other means.

Yet another object of the invention is to maintain a proper balance between downward and lateral forces applied to a polishing pad handle during use, whereby the pad will separate from the handle if such a balance is not maintained.

According to the invention, a method of cleaning or polishing the exterior body surface of a vehicle by hand, includes forming a working pad having a handle attachment part with a first flat surface substantially parallel a bottom work surface of the pad, and providing a handle with a hand grip part and a pad engaging part fixed with respect to the hand grip part and having a second flat surface. The handle and the working pad are fitted to one another by friction so as to facilitate easy separation later. One of the pad engaging and handle attachment parts is urged into a recess in the other one of said parts to engage the other part by friction, and the first flat surface of the handle attachment part is aligned flush with the second flat surface of the pad engaging part.

The method also includes grasping the hand grip part of the handle and exerting a downward force which is transmitted through the flush first and second flat surfaces evenly across the bottom work surface of the pad. The pad while fitted to the handle is then wiped over the vehicle body surface while a downward force is exerted on the handle.

For a better understanding of the present invention, together with other and further objects, reference is made to the following description taken in conjunction with the accompanying drawing, and the scope of the invention will be pointed out in the appended claims.

DETAILED DESCRIPTION OF THE INVENTION

Figure 1:
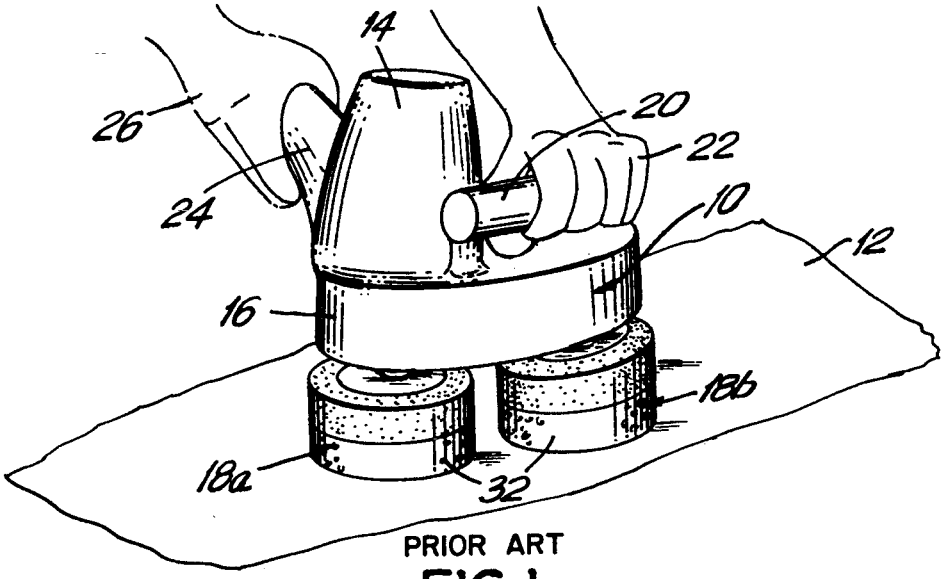
PRIOR ART FIG. 1
FIG. 1 is a view of a conventional power orbital polishing machine in use.

FIG. 1 shows a conventional power orbital polisher 10 as used to polish a surface 12 on, e.g., an automobile. The polisher 10 has an electric motor housing 14, and a casing 16 that contains motor drive components including such gearing (not shown) as is necessary to drive a pair of polishing pads 18*a*, 18*b* for rotational and orbital movement relative to the surface 12.

The polisher 10 also has a bar handle 20 fixed across a forward portion of the top of casing 16 to enable the polisher to be gripped with a user's left hand 22. Another handle 24 protrudes rearwardly of the casing 16 to be grasped by the user's right hand 26. When energized via an AC line cord (not shown), the polisher 10 drives the polishing pads 18*a*, 18*b* for rotational movement against the surface 12 as the user guides the polisher 10 over an area of the surface 12 to be polished.

Figure 2:
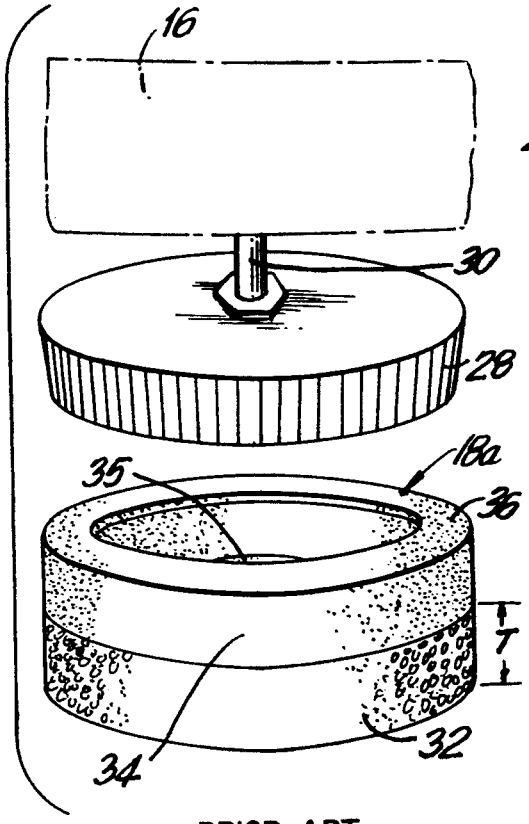
PRIOR ART FIG. 2
FIG. 2 is an enlarged view showing a polishing pad and a power drive wheel of the machine in FIG. 1.

FIG. 2 shows one of the polishing pads 18*a* as detached from a power drive wheel or disk 28. The disk 28 is fixed to a shaft 30 which, in turn, is connected to an eccentric rotary member (not shown) that is driven by the motor housed in the polisher 10.

Each polishing pad is comprised of a foam working part 32 in the form of a cylindrical pad having a certain thickness T. The working part 32 of the polishing pads 18*a*, 18*b* may be made of any foam material currently used in cleaning or polishing applications, for example, urethane, polyester, polyether or polyethylene foam materials.

The pads 18*a*, 18*b* also have an attachment part 34 extending upwardly from the top surface of the working part 32. The attachment part 34 is in the form of a hollow rubber cup having a thin rubber lip 36 extending radially inwardly from the upper circumference of the attachment part 34. The attachment part 34 is fixed to the working part 32 of the pad 18*a* by way of an adhesive applied between an elastic bottom surface 35 of the attachment part 34, and the upper surface of the working part 32. The overall diameter of the pad 18*a* is typically about four inches.

Figure 3:
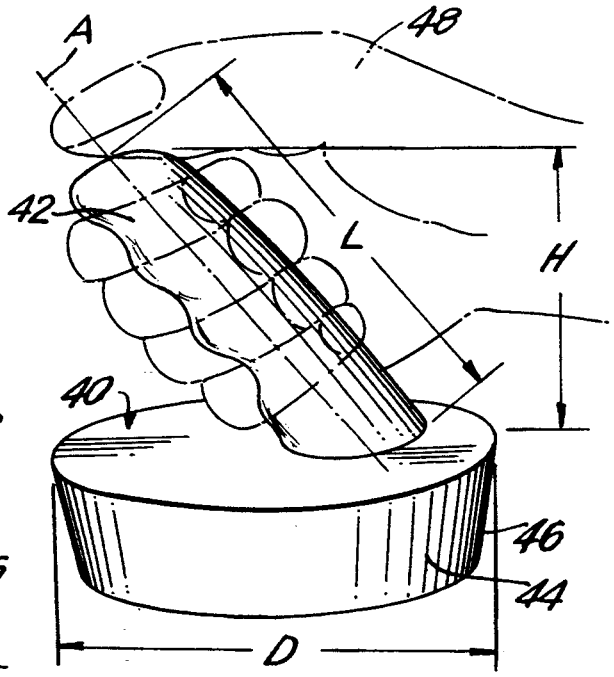
FIG. 3 is a perspective view of a polishing handle according to the invention.

FIG. 3 is a perspective view of a polishing or cleaning handle 40 according to a first embodiment of the invention.

As mentioned, pad 18*a* is secured to the power drive disk 28 of polisher 10 by way of a tight friction fit between the elastic attachment part 34 of the pad including the thin rubber lip 36, and the disk 28 when the latter is inserted in the hollow of the attachment part 34 with the wall of the attachment part and the lip 36 stretched tightly over the outer periphery of the disk 28 (see FIG. 1). Such a tight or friction fit between the pads 18*a*, 18*b* and the corresponding power drive disks 28 of polisher 10 has proven adequate to allow the working parts 32 of the pads to engage surfaces to be cleaned or polished while undergoing both rotational and lineal or orbital movement relative to the surface.

According to the invention, the cleaning or polishing handle 40 has a hand grip part 42 in the form of a "pistol" grip, and a pad engaging part 44. The handle 40 can be used together with the cleaning/polishing pad 18*a* of FIG. 2 by forming the outer periphery of the engaging part 44 with such shape and dimensions as to be fitted tightly in the attachment part 34 of the pad 18*a*. That is, the pad engaging part 44 may correspond in shape to the power drive disk 28 in FIG. 2.

As shown in FIG. 3, the engaging part 44 of the handle has a typical diameter D of about 3.75 inches if used with one of the commercially available pads 18*a*. The engaging part 44 preferably has a slight beveled edge 46 that extends radially inwardly toward the bottom surface of the engaging part 44. The overall height H of the hand-grip part 42 from the upper surface of the engaging part 44 measures typically about 4 inches and the length L of grip part 42 is about 5 inches long to accommodate the closed hand or fist 48 of a user.

Figure 7:
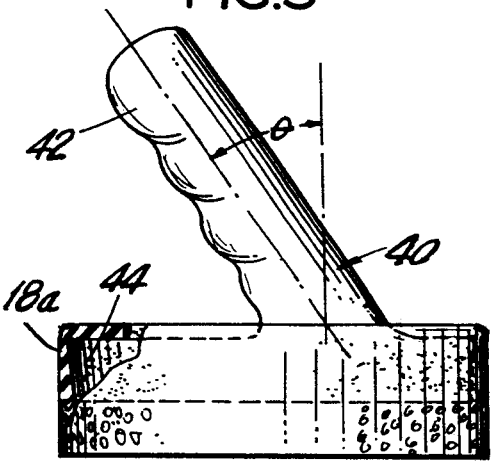
FIG. 7 is a side view, partly in section, of the handle of FIG. 3 fitted in the polishing pad of FIG. 2.

Importantly, the axis A of hand-grip part 42 is offset angularly from the normal direction relative to the surface to be cleaned or polished when a pad 18*a* is fitted over the engaging part 44, as depicted in FIG. 7. It has been discovered that the user can exert relatively large downward forces on the handle 40 and thus onto the pad 18*a* while engaging a work surface, and maintain such forces while moving the handle and pad combination over the surface for long periods of time with relatively little user discomfort or fatigue as compared to the common method of using a polishing cloth or pad alone by hand. When cleaning surfaces approximately at the height of the user's elbow such as the front hood or rear trunk of an automobile, it has been found that an offset angle $\partial$ of about 40 degrees between the axis A and the normal direction N (See FIG. 7) affords the user great working efficiency with minimal fatigue during the course of an entire automobile cleaning or waxing operation. If the handle and pad combination of the present invention is often used for cleaning surfaces much higher or lower than the user's elbow level, the offset angle of axis A of the grip part 42 can be modified to approach the direction of the normal N (FIG. 7) for surfaces higher than the user's elbow level, or to depart further from the normal direction for lower surfaces.

Although the material of the working part 32 of the pad 18*a* has been described as made of foam for use in cleaning or polishing, other materials for the working part 32 may be employed for purposes of cleaning, scouring, sanding, or any other working or finishing operation to be applied to a surface which operation requires a hand rubbing force.

The handle 40 can be made of any rigid, non-harmful durable material including but not limited to wood, various metals, fiberglass, or any of the common plastics materials capable of being cast or molded into a desired form at relatively low cost.

Figure 4:
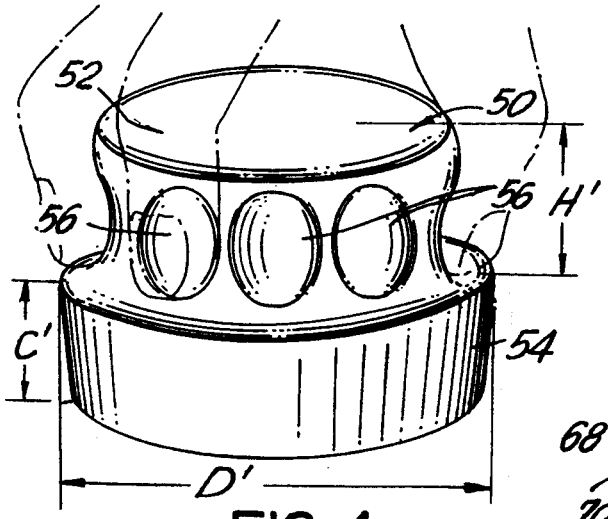
FIG. 4 is a perspective view of a second embodiment of a polishing handle according to the invention.

FIG. 4 is a view of a handle 50 according to a second embodiment of the invention.

The handle 50 can be made of any of the materials mentioned in connection with the handle 40 of FIG. 3, and includes a hand-grip part 52 and pad engaging part 54. The pad engaging part 54 corresponds in shape and dimensions to the pad engaging part 44 of the handle 40, i.e., part 54 conforms in shape to the hollow space in the attachment part 34 of the pad 18*a* in FIG. 2. Handle 50 differs from handle 40, however, in the form of the grip part 52 which, as shown, conforms to a user's hand and fingers with the palm facing downwardly. A series of dimples 56 or finger indents are formed in a circumferential wall of the grip part 52 to allow the user's fingers and thumb to grasp the part 52 of the handle 50 most comfortably while obtaining a tight grip.

As with the handle 40 of FIG. 3, handle 50 has a maximum diameter D' of about $\frac{3}{4}$ inches, with the depth C' of part 54 measuring about 0.75 inches. The overall height H' of the grip part 52 is about 1.75 inches.

Figure 5:
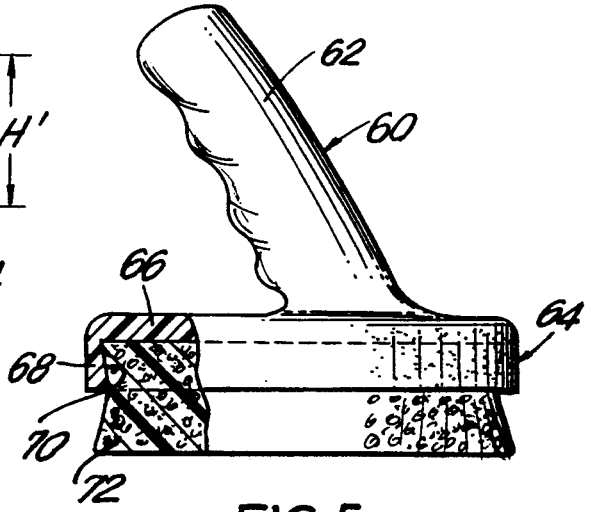
FIG. 5 is a side view, partly in section, of a polishing handle and pad arrangement according to a third embodiment of the invention.

FIG. 5 is a view of a third embodiment of a handle and pad arrangement according to the invention. A handle 60 is formed with a hand grip part 62 similar in shape and form to the grip part 42 of the handle 40 in FIG. 3. Handle 60 also has a pad engaging part 64 comprised of a flat circular base 66 to which the grip part 62 is joined, and an annular lip 68 extending downwardly from the outer circumference of the base 66 as shown in FIG. 5. The annular lip 68 has an inner periphery 70 that tapers radially inwardly in the direction away from the grip part 62, and a cleaning or polishing pad 72 of foam or other resilient material is captured by the handle lip 68 after the material of the pad 72 is compressed in its upper region to be fitted inside the lip 68, flush against the bottom of the handle base 66.

Figure 6:
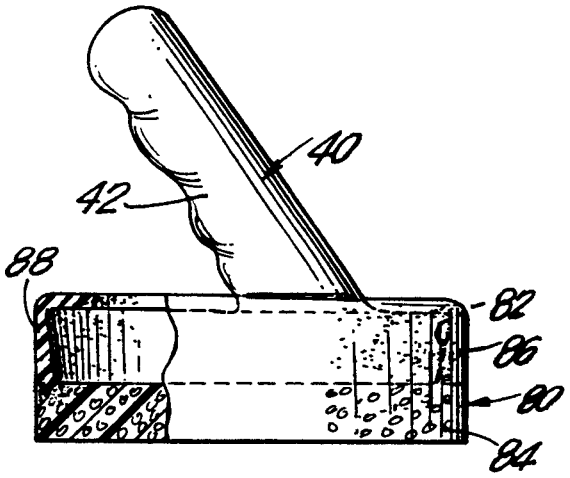
FIG. 6 is a side view, partly in section, showing the handle of FIG. 3 fitted in a polishing pad made according to the invention.

FIG. 6 is a view showing the handle 40 of FIG. 3 fitted within a pad 80 having a working part 84 made of foam or other suitable cleaning or polishing material. Pad 80 has an engaging or attachment part 86 for gripping the base part of the handle 40. An annular elastic ring 88 corresponding to the attachment part 34 of the pad 18*a* in FIG. 7, extends from the upper circumference of the working part 84, and defines an upper recess 82 for receiving the handle base. Ring 88 may be molded together with the material of the working part 84 of the pad 80, glued or otherwise adhered to the working part 84 with sufficient strength to withstand normal working forces applied through the handle 40 to the pad 80.

Figure 8:
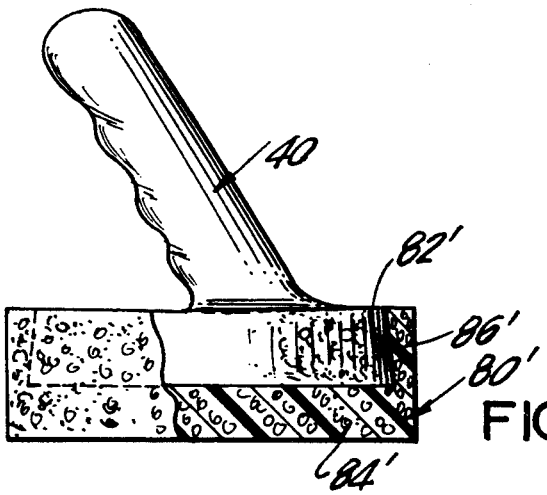
FIG. 8 is a side view, partly in section, of the handle in FIG. 3 fitted in a polishing pad made entirely of foam material.

FIG. 8 is a view showing the handle 40 of FIG. 3 fitted within a pad 80' made entirely of foam or other suitable cleaning or polishing material. Pad 80' differs from the pad 18*a* in FIG. 2 in that the pad 80' is formed with an upper recess 82' such that a working part 84' and an engaging or attachment part 86' of the pad are formed integrally of the same material by, e.g., a molding process. Alternatively, the pad 80' can be formed by cutting out a circular or conical section of foam from a cylindrical foam piece, to form the recess 82'. The strength of the pad material forming the engaging part 86' may be greater than that of the material residing in the working part 84' to enable the pad 80' to stand up to various forces transmitted via the handle 40 when fitted tightly in the upper recess 82' of the engaging part 86'.

In a variation of the embodiment of FIG. 8, a one-piece polishing or cleaning unit may be obtained by forming the entire handle 40 from the material used to form the engaging part 86. The handle/pad combination may then be molded integrally with, e.g., a softer foam material at the working part and a harder foam material at the engaging and handle parts.

In use, prior to cleaning the exterior body surface of an automobile or other vehicle, a suitable conventional cleaning or polishing agent may be placed either on the work surface of the polishing pad, or directly on the vehicle body surface. The cleaning agent may be in paste or liquid form, and include an abrasive material ranging from very coarse to extremely fine grade depending on the kind of finish desired.

One of the handles is then fitted to a corresponding working pad either by (1) urging the pad engaging part of the handle into the recess in the handle attachment part of the pad thereby engaging the pad by friction, or by (2) urging the handle attachment part of the pad into the recess in the pad engaging part of the handle thereby engaging the handle by friction. In either case, it will be appreciated that later separation of the handle and the working pad is facilitated when a used pad is to be removed and replaced with a new one of like construction. Because the pad is not permanently attached to the handle by an adhesive or other means, it will also separate from the handle during use if excessive lateral or frictional forces are encountered. This "pop off" kind of action is highly desirable because it (1) saves the pad from becoming torn by excessive working stresses, and (2) alerts the user that the liquid or paste cleaning agent being worked on the body surface is becoming dry and that more agent needs to be applied.

With the first flat surface of the handle attachment part of the pad aligned flush with the second flat surface of the pad engaging part of the handle, the user grasps the handle and exerts a downward force which is transmitted through the flush surfaces evenly across the work surface of the pad. The pad therefore always maintains uniform contact with the body surface of the vehicle during use.

Once fitted to the handle, the working pad is then wiped by hand over the vehicle body surface while exerting the downward force on the handle.

As mentioned, an important feature of the present polishing technique is to provide a pad friction or stress limit warning feature. When polishing a vehicle with either a liquid or paste type abrasive polish, it is important to keep the polish "wet". Once the cleaning or polishing agent dries, additional rubbing will only remove the agent from the surface being worked and further polishing action will not take place. Polishing agents usually contain water or oil to make them wet. When the agents are rubbed onto the surface of a vehicle, friction is created by lateral movement between the work surface of the applicator cloth or pad, and the vehicle body surface on which the polishing agent is applied. As the polishing agent dries, the friction increases and lateral movement of the cloth or pad over the vehicle surface requires greater and greater hand-applied force to overcome. The necessary force increases up to the time of complete drying of the polishing agent, at which no further polishing action occurs and the dry polish is simply removed by further hand rubbing.

According to the present technique, at or near the time when the polishing agent becomes completely dry, the side-ways or lateral forces exerted by the handle on the fitted pad will deform the pad sufficiently to enable the handle base to unseat itself from the recess in the polishing pad, or the pad will become unseated from the recess in the handle base (depending on which embodiment of the present handle and pad combinations is being used). This "pop off" feature alerts the user to apply more polish or simply to apply a little water to the surface being polished. Either way, the lateral frictional forces will be reduced and polishing action can be continued after the pad is replaced on the handle and wiped over the vehicle surface.

It will be appreciated that the point at which the polishing pad will unseat itself from the handle during use because of excessive friction as the polishing agent dries, is a function of (a) the pad's density and configuration, (b) the kind of polish being used, and (c) the degree of both downward and lateral forces being exerted on the handle at a given time. Different kinds of foam materials for the polishing pad will require a different minimum downward force to be applied via the handle while working a polishing agent of proper consistency on the vehicle body. A user will quickly learn the proper balance between downward and lateral hand forces when using a polishing agent of the proper consistency. If the correct balance is not maintained, the handle and pad will become separated during use.

Also, as mentioned, because the polishing pad is not permanently adhered to the handle, the pad will be protected from tearing by excessive lateral forces, by becoming separated from the handle during use.

In all cases, after the polishing agent is worked over the vehicle surface by the pad and becomes dry, all residue should be removed either by washing the vehicle with water and allowing it to dry, or by light buffing with a dry cloth.

EXAMPLE ONE

A handle and pad combination as shown in FIG. 8 was used to clean and polish a 1985 Chrysler, Fifth Avenue model, having Black Crystal coat paint (Chrysler code PX8). Ambient temperature was 75° F. A liquid water based polish obtained from Malm Chemical Corp., Pound Ridge, N.Y., was also used (Malm's Ultra-Fine Polishing Cleaner, Stock No. 5556-P.

The entire handle 40 was made of injected molded plastics consisting of a 50 percent mixture of polycarbonate and 50 per cent ABS. The grip part 42 of the handle was textured with "Mold-Tech" #MT-1013, and the pad attachment part 44 of the handle was textured with "Mold-Tech" #MT-1145. The bottom surface of the attachment part was 3.275 inches diameter. The attachment part was 0.775 inches high, and the diameter of the top surface of the attachment part was 3.325 inches diameter.

The foam pad was formed of yellow, open cell polyether foam having an overall diameter of 4.0 inches and an overall height of 1.2 inches. The diameter of the recess in the pad was 3.075 inches, and the depth of the recess was 0.850 inches. The pad material was made by General Foam Corp. in Pennsylvania, polyether foam grade 13000XXX, and having a cell count of 36.

The vehicle surface was first washed with a mixture of one ounce Malm Chemical Corp. liquid car wash diluted with two gallons water. The vehicle was then dried.

One tablespoon of polish was placed on the vehicle hood, and the foam pad then placed in contact with the polish. The pad engaging part of the handle was then urged into the pad recess using about two pounds force.

The handle/pad combination was then moved in a circular motion defining approximately 12-inch diameter circles over the flat surface of the vehicle hood, covering no more than 4 square feet. About ten pounds downward force was applied on the handle. After about two minutes, the liquid polish began to dry and lateral friction resistance increased considerably to the time when the polish became totally dry. Any further attempts at lateral movement caused the pad attachment part of the handle to become unseated from the recess in the polishing pad.

A tablespoon of water was then added to the now-dry surface, in order to wet the dry polish residue. The water softened the polish to the point where easy lateral movement of the pad again became possible, and further polishing action took place.

As mentioned, it is important to understand that the primary purpose of the present technique is to enable liquid or paste polishes or waxes to be worked on a vehicle body surface with minimal user fatigue. When the polishing or waxing process is completed, the dry polish residue or excess wax should be removed either by washing the vehicle or buffing the vehicle surface with a dry cloth.

It will be appreciated that when carrying out the present hand polishing technique using any of the embodiments of FIGS. 3–8, the exterior body surface of a vehicle can be cleaned or polished very effectively, with significantly reduced hand, finger or wrist fatigue as is common in conventional hand polishing methods.

While the foregoing description represents a preferred embodiment of the invention, it will be obvious to those skilled in the art that various changes and modifications may be made without departing from the true spirit and scope of the invention as pointed out in the following claims.

What I claim is:

1. A method of cleaning or polishing surfaces of a vehicle with a polishing apparatus comprising a polishing pad and a handle that are friction fit together to be separable by deformation of the pad from lateral forces on the handle upon exceeding a predetermined friction force from a dry surface that is produced between the pad and the surface being cleaned or polished, the method comprising the steps of:

(a) selecting a surface to be cleaned or polished;

(b) applying a cleaning or polishing agent to at least one of the pad or a portion of the surface;

(c) spreading the cleaning or polishing agent over the surface by moving the polishing pad fitted to the handle over the surface while exerting a downward force on the handle thereby producing a friction force between the pad and the surface; and (d) stopping the application of the agent to the surface when the pad is separated from the handle upon the friction force exceeding a predetermined friction force.

2. The method of claim 1, wherein the polishing pad is formed of an elastic foam material.

3. The method of claim 2, wherein the pad is formed of polyether.

4. The method of claim 1, wherein the cleaning or polishing agent is applied to a work surface of the pad prior to carrying out the step (c).

5. The method of claim 1, wherein the cleaning or polishing agent is applied to the surface prior to carrying out the step (c).

6. The method of claim 2, wherein the pad is formed of an elastic material such that the pad deforms and separates from a pad engaging part of the handle during the step (c) when the cleaning or polishing agent becomes substantially dry.

7. The method of claim 6, wherein the pad is formed of polyether foam.

8. The method of claim 3, wherein the pad is formed of an elastic material such that the pad deforms and separates from a pad engaging part of the handle during the step (c) when the cleaning or polishing agent becomes substantially dry.

9. The method of claim 8, wherein the pad is formed of polyether foam.

10. The method of claim 1, further including the steps of providing a further quantity of cleaning or polishing agent and then repeating the step (c).

11. The method of claim 1, further including the steps of providing a quantity of water to the cleaning or polishing agent and then repeating the step (c).

* * * * *